US011614211B1

(12) United States Patent
Peng

(10) Patent No.: US 11,614,211 B1
(45) Date of Patent: Mar. 28, 2023

(54) TYPE OF MUSIC STARRY SKY PROJECTION LAMP

(71) Applicant: Feng Peng, Hunan (CN)

(72) Inventor: Feng Peng, Hunan (CN)

( * ) Notice: Subject to any disclaimer, the term of this patent is extended or adjusted under 35 U.S.C. 154(b) by 0 days.

(21) Appl. No.: 17/839,086

(22) Filed: Jun. 13, 2022

(30) Foreign Application Priority Data

Sep. 16, 2021 (CN) ..... 202122246715.3

(51) Int. Cl.

| | |
|---|---|
| ***F21S 10/00*** | (2006.01) |
| ***F21V 5/04*** | (2006.01) |
| ***F21V 33/00*** | (2006.01) |
| *F21W 121/00* | (2006.01) |

(52) U.S. Cl.
CPC ..... *F21S 10/007* (2013.01); *F21S 10/002* (2013.01); *F21V 5/04* (2013.01); *F21V 33/0056* (2013.01); *F21W 2121/008* (2013.01)

(58) Field of Classification Search
CPC ..... F21S 10/00; F21S 10/002; F21S 10/007; F21V 5/008; F21V 5/04; F21V 5/048; F21V 33/0056; F21W 2121/008
See application file for complete search history.

(56) References Cited

U.S. PATENT DOCUMENTS

| | | | | |
|---|---|---|---|---|
| 10,041,651 | B1 * | 8/2018 | Xi | F21S 10/00 |
| 11,118,753 | B1 * | 9/2021 | Zheng et al. | F21V 33/0056 |
| 2021/0381666 | A1 * | 12/2021 | Zheng et al. | F21V 5/04 |

* cited by examiner

*Primary Examiner* — Y M. Quach Lee
(74) *Attorney, Agent, or Firm* — Muncy, Geissler, Olds & Lowe, P.C.

(57) ABSTRACT

The invention discloses a new type of music starry sky projection lamp, comprising a casing, a projection component provided in the casing, and a thumb wheel component; the projection component comprises a swinging transparent water pattern cover, a swinging arm, a fixing plate, a projection lamp bead, and a motor; the thumb wheel component comprises a thumb wheel device body, a thumb wheel lamp bead, a thumb wheel pattern plate, a plano-convex condenser, a biconvex lens, and a pattern plate positioning device. The invention is provided with a swinging transparent water pattern cover, pattern pieces, and a variety of pattern imaging transparent covers, so that the irradiated light is imaged as water pattern or cloud and fog, the irradiated light is imaged into a beautiful pattern, and the projected pattern can be switched by rotating the thumb wheel pattern plate, and can simulate different and various starry sky projection effects.

6 Claims, 11 Drawing Sheets

TYPE OF MUSIC STARRY SKY PROJECTION LAMP

1. TECHNICAL FIELD

The invention relates to the field of projection lamps, in particular to a new type of music starry sky projection lamp.

2. BACKGROUND ART

Projection lamp is a decorative lighting device that projects patterns on walls, ceilings and lawns. It can create an atmosphere and decorate the landscape, and has a very wide range of applications in life. Projection lamps in the prior art have complex structures, mostly static projections, and less dynamic projections, and basically all have a single usage scene.

Therefore, the technical problem reflected above is an urgent problem to be solved by those skilled in the art.

3. SUMMARY OF THE INVENTION

The purpose of the invention is to provide a new type of music starry sky projection lamp.

In order to achieve the above purpose, the invention adopts the following technical solutions: a new type of music starry sky projection lamp, comprising a casing, a projection component provided in the casing, and a thumb wheel component;

The projection component comprises a swinging transparent water pattern cover, a swinging arm, a fixing plate, a projection lamp bead, and a motor; both sides of the swinging transparent water pattern cover are rotatably connected to the fixing plate; the lower end of the swinging arm is eccentrically and fixedly connected to the output end of the motor; the upper end of the swinging arm is rotatably matched with one side of the swinging transparent water pattern cover; the projection lamp bead is arranged below the swinging transparent water pattern cover;

The thumb wheel component comprises a thumb wheel device body, a thumb wheel lamp bead, a thumb wheel pattern plate, a plano-convex condenser, a biconvex lens, and a pattern plate positioning device; the thumb wheel lamp bead, the thumb wheel pattern plate, the plano-convex condenser, and the biconvex lens are arranged from bottom to top on the inner side of the thumb wheel device body; the lower end of the pattern plate positioning device passes through the thumb wheel device body and is fixedly connected to the thumb wheel device body; the thumb wheel pattern plate is rotatably connected to the thumb wheel device body; the thumb wheel pattern plate is provided with pattern pieces arranged in a ring shape; the outer side of the thumb wheel pattern plate is provided with positioning grooves, and the positioning grooves are matched with the lower end of the pattern plate positioning device.

A new type of music starry sky projection lamp, further comprising a laser component; the laser component comprises a laser emitting device, a grating sheet, and a grating cover; the upper end of the laser emitting device passes through the casing; the grating sheet and the grating cover are arranged on the upper end of the laser emitting device.

As an improvement, the casing comprises an upper casing, a lower casing, and a pattern imaging transparent cover that are arranged in combination up and down; the pattern imaging transparent cover is arranged above the top surface of the upper casing facing the projection component.

As an improvement, the pattern plate positioning device comprises a spring and a positioning column; the lower end of the positioning column is matched with the positioning groove; the spring is arranged between the thumb wheel device body and the positioning column As an improvement, the casing is provided with a speaker.

As an improvement, the casing is provided with a circuit board.

Compared with the prior art, the advantages of the invention are: the invention is provided with a swinging transparent water pattern cover, so that the irradiated light is imaged as water pattern or cloud and fog, and has dynamic effect; the invention is provided with pattern pieces, the irradiated light is imaged into a beautiful pattern, and the projected pattern can be switched by rotating the thumb wheel pattern plate; the invention is provided with a variety of pattern imaging transparent covers, which can simulate different and various starry sky projection effects.

4. BRIEF DESCRIPTION OF ACCOMPANY DRAWINGS

Figure 1:
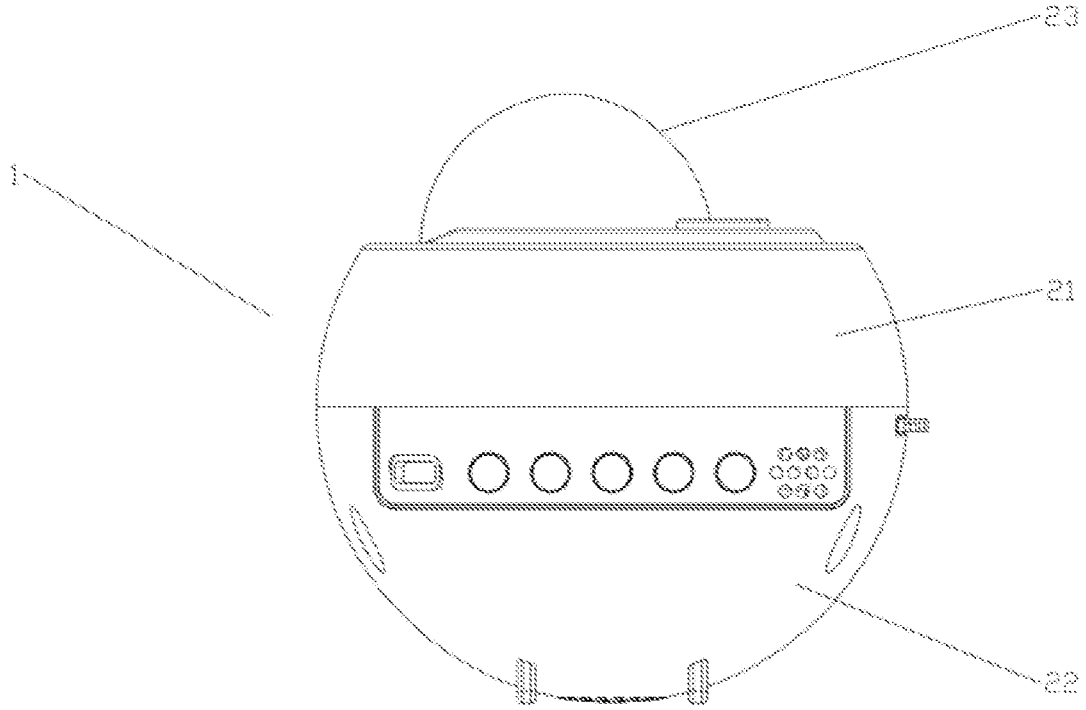
FIG. 1 is a front view of Embodiment 1 according to the invention.
Figure 2:
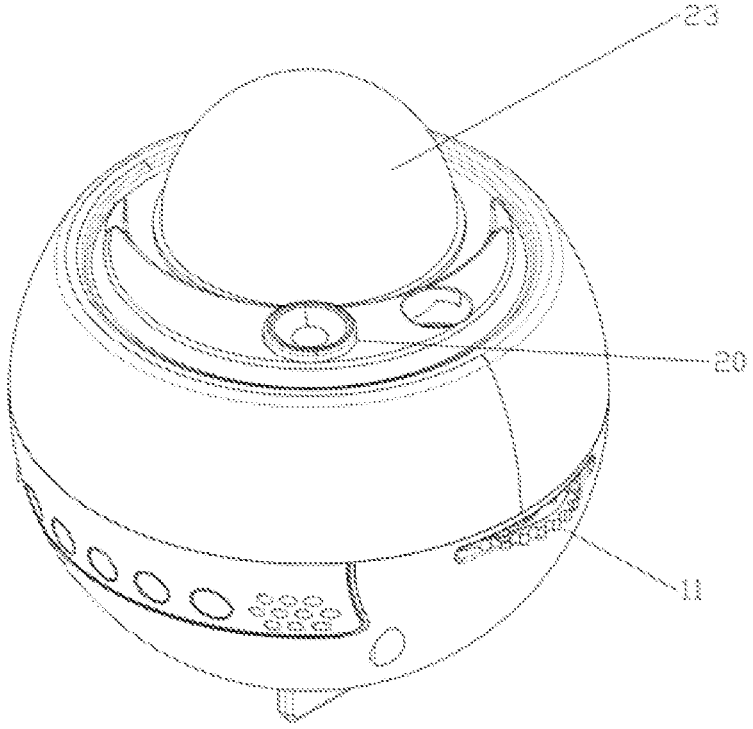
FIG. 2 is a perspective view of Embodiment 1 according to the invention.
Figure 3:
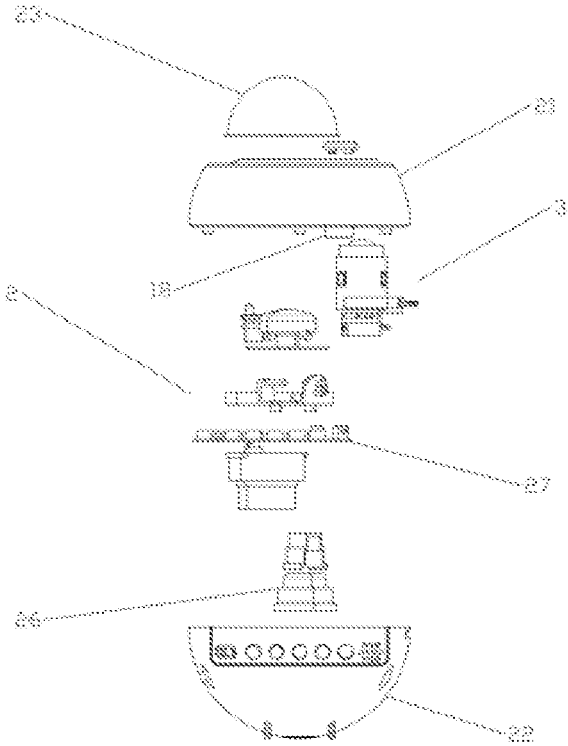
FIG. 3 is a first exploded structure diagram of Embodiment 1 according to the invention.
Figure 4:
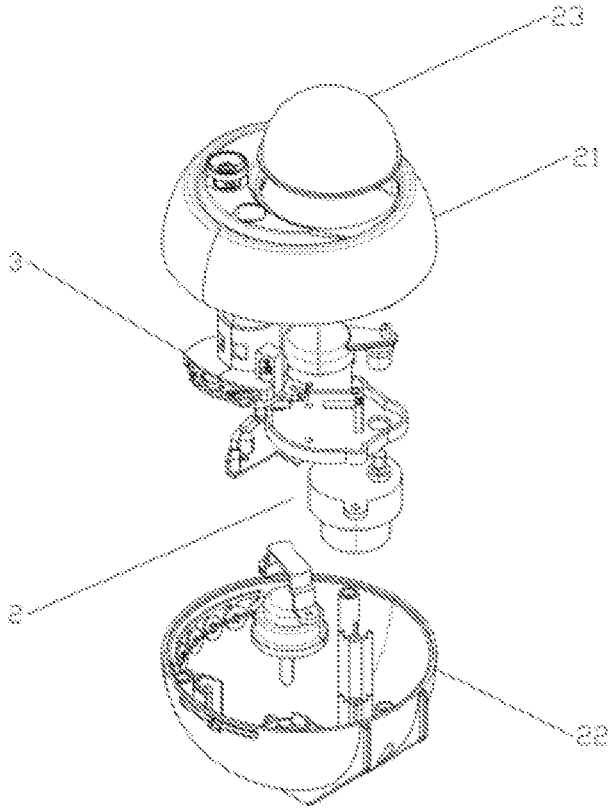
FIG. 4 is a second exploded structure diagram of Embodiment 1 according to the invention.
Figure 5:
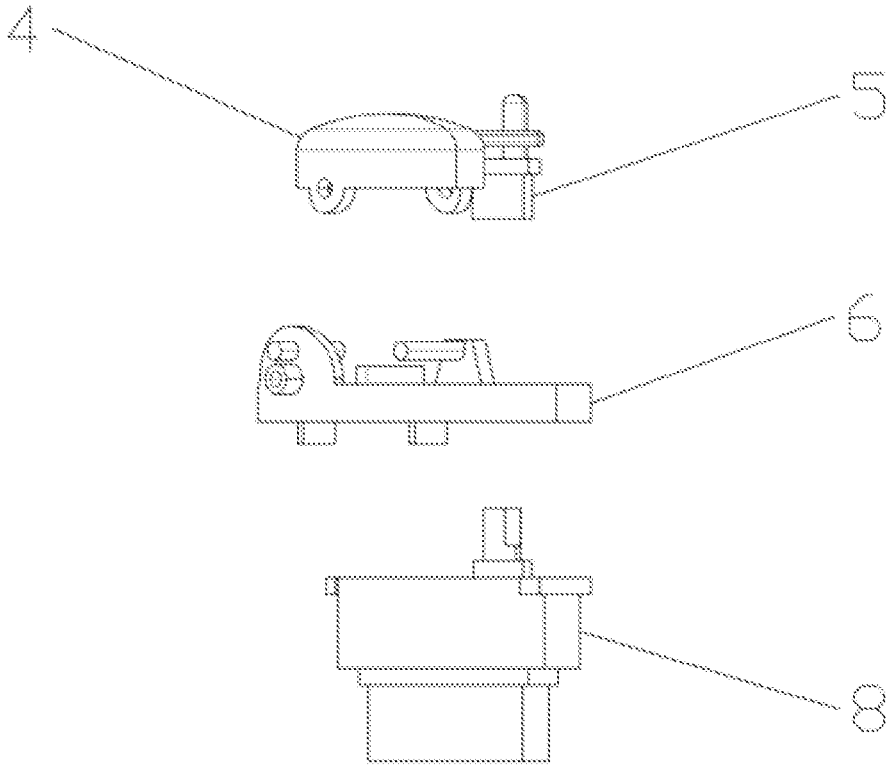
FIG. 5 is a first exploded structure diagram of the projection component in Embodiment 1 according to the invention.
Figure 6:
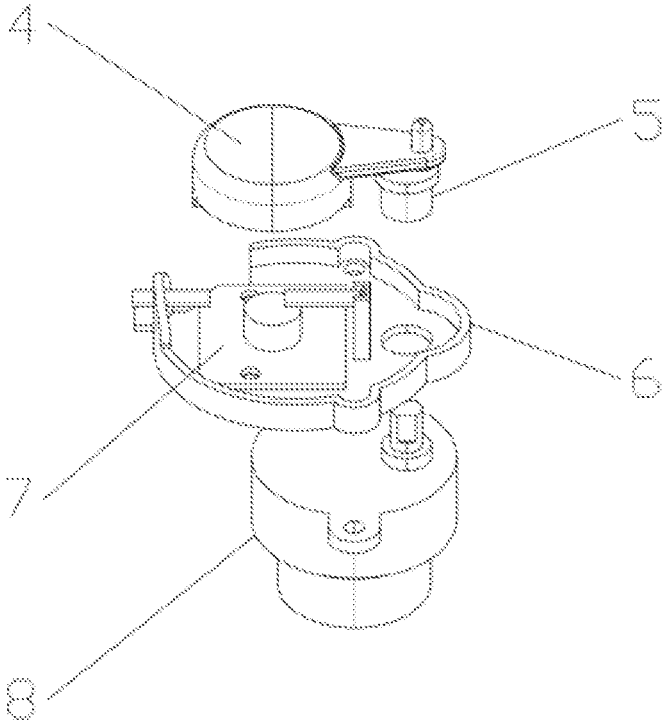
FIG. 6 is a second exploded structure diagram of the projection component in Embodiment 1 according to the invention.
Figure 7:
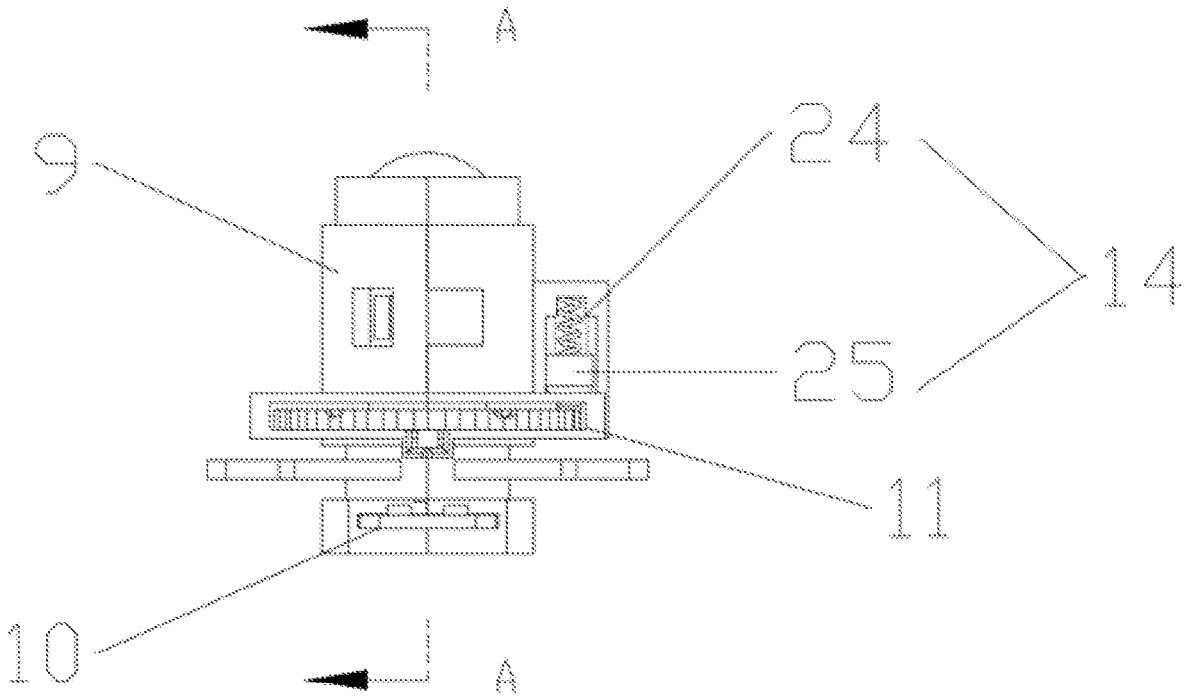
FIG. 7 is a front view of the thumb wheel component in Embodiment 1 according to the invention.
Figure 8:
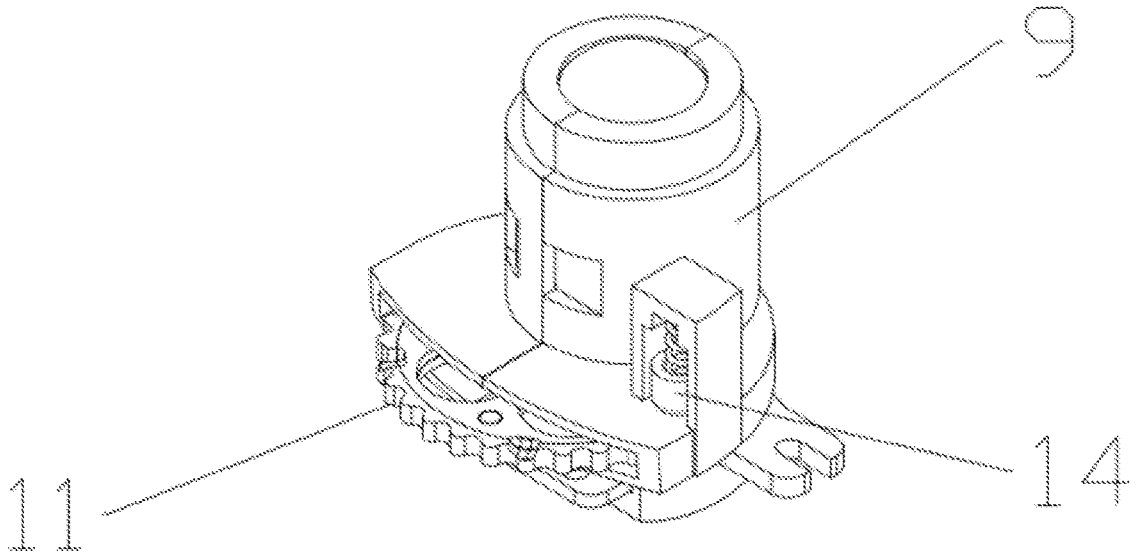
FIG. 8 is a perspective view of the thumb wheel component in Embodiment 1 according to the invention.
Figure 9:
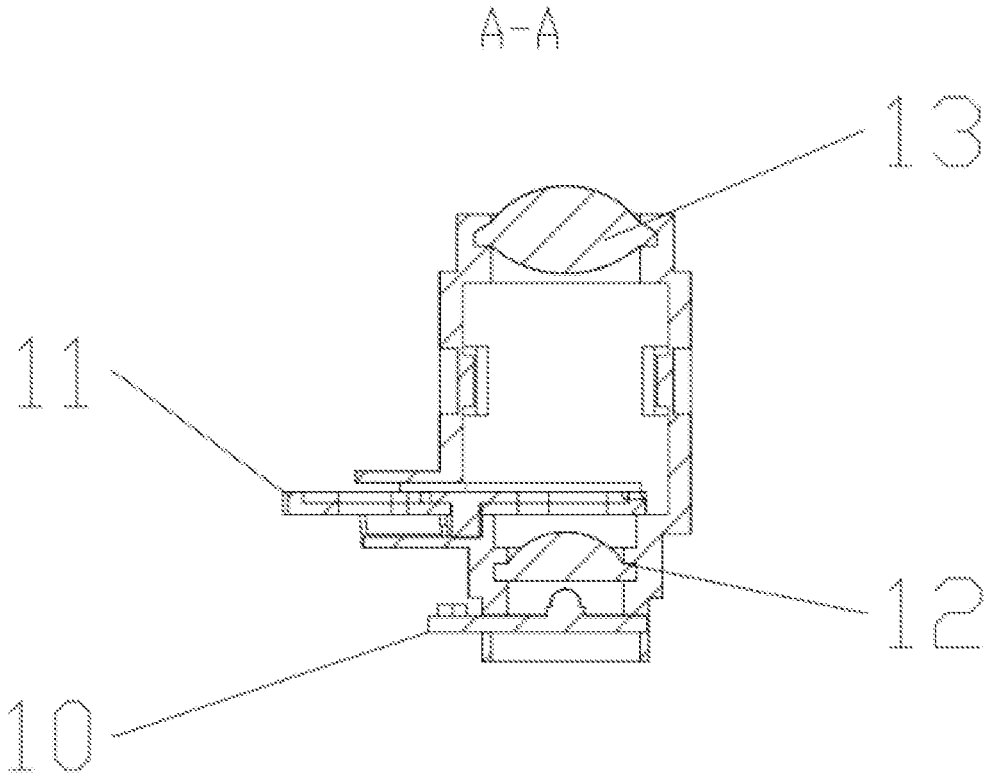
FIG. 9 is an A-A sectional view of the thumb wheel component in Embodiment 1 according to the invention.
Figure 10:
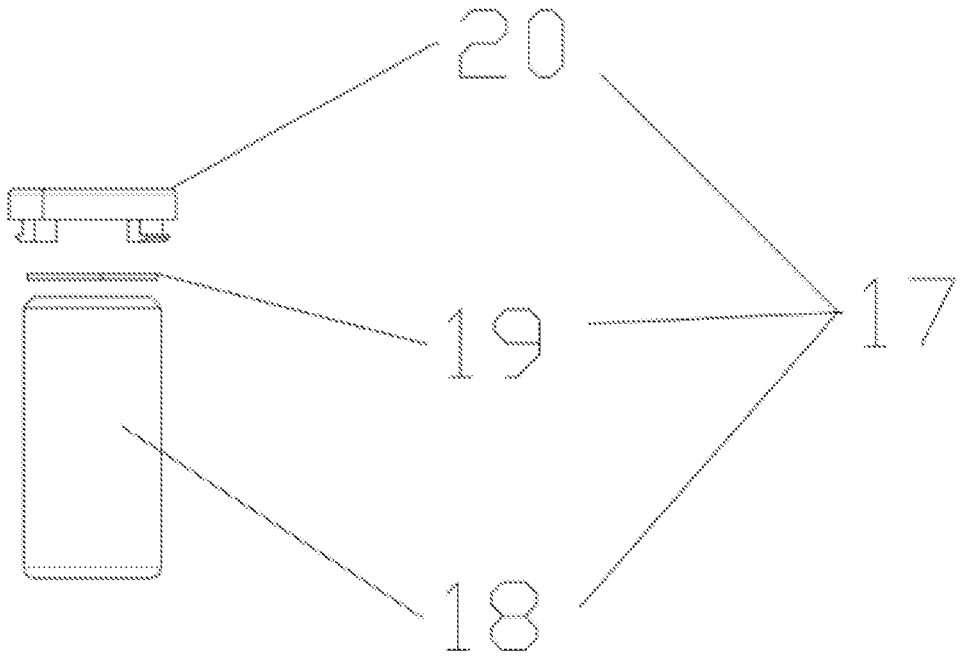
FIG. 10 is a front view of the laser component in Embodiment 1 according to the invention.
Figure 11:
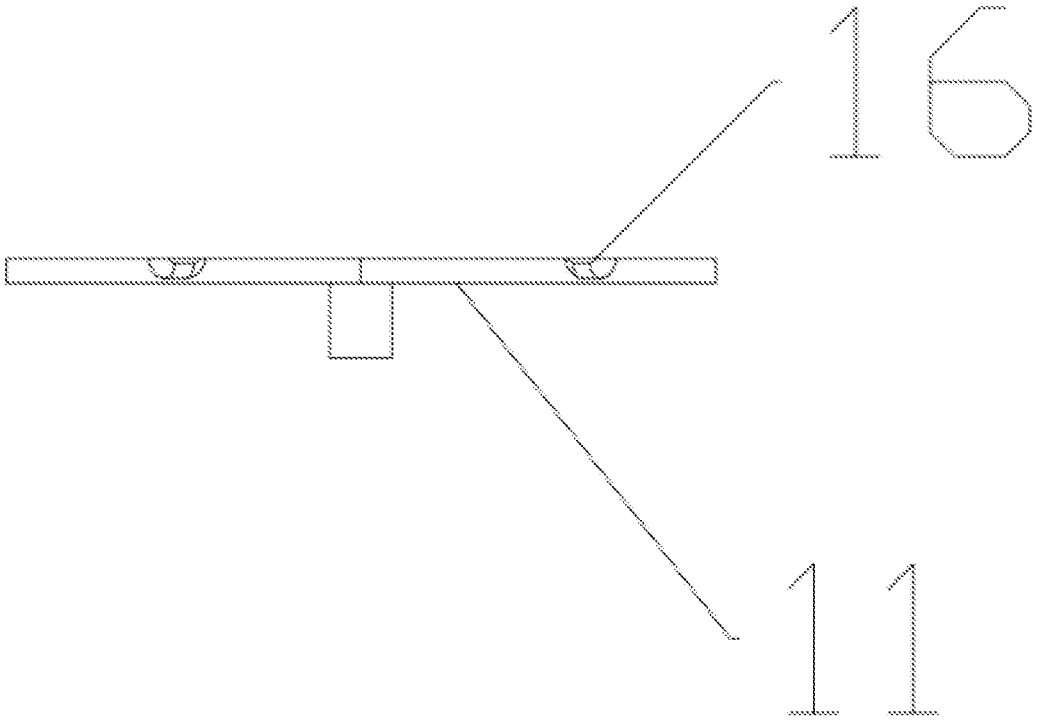
FIG. 11 is a front view of the thumb wheel pattern plate in Embodiment 1 according to the invention.
Figure 12:
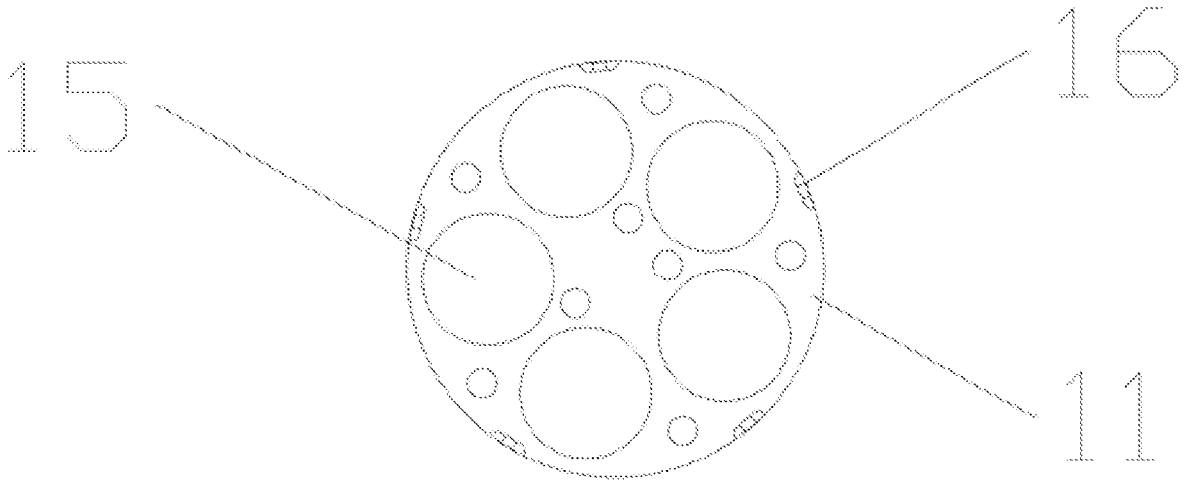
FIG. 12 is a top view of the thumb wheel pattern plate in Embodiment 1 according to the invention.
Figure 13:
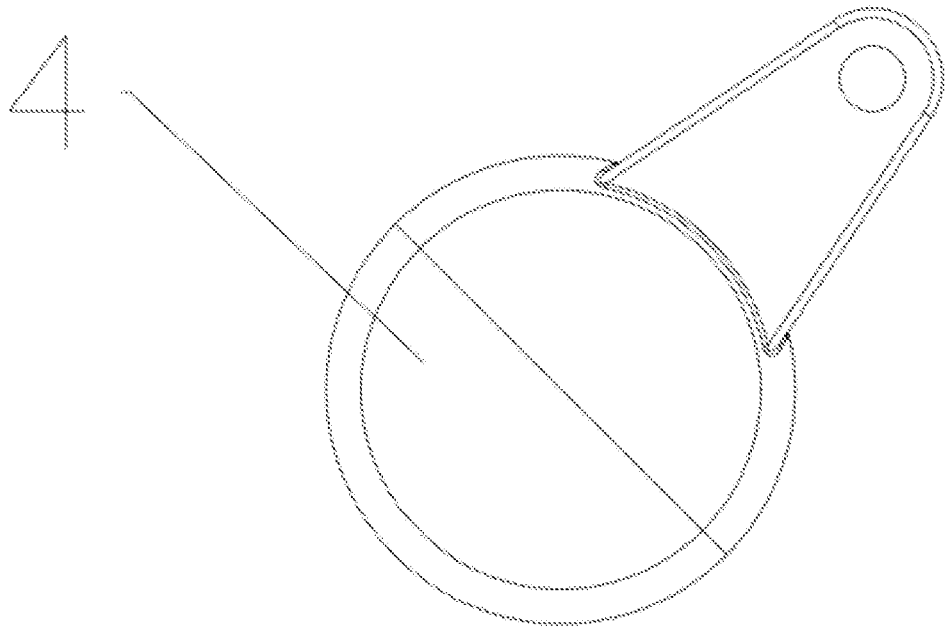
FIG. 13 is a top view of the swinging transparent water pattern cover in Embodiment 1 according to the invention.
Figure 14:
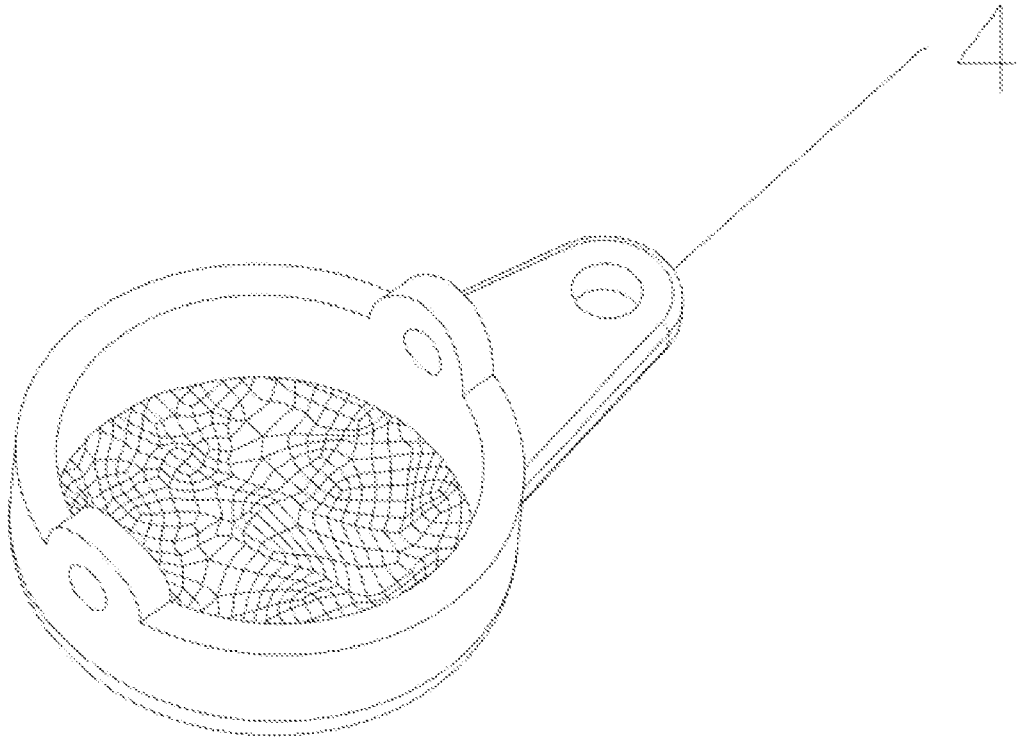
FIG. 14 is a perspective view of the swinging transparent water pattern cover in Embodiment 1 according to the invention.
Figure 15:
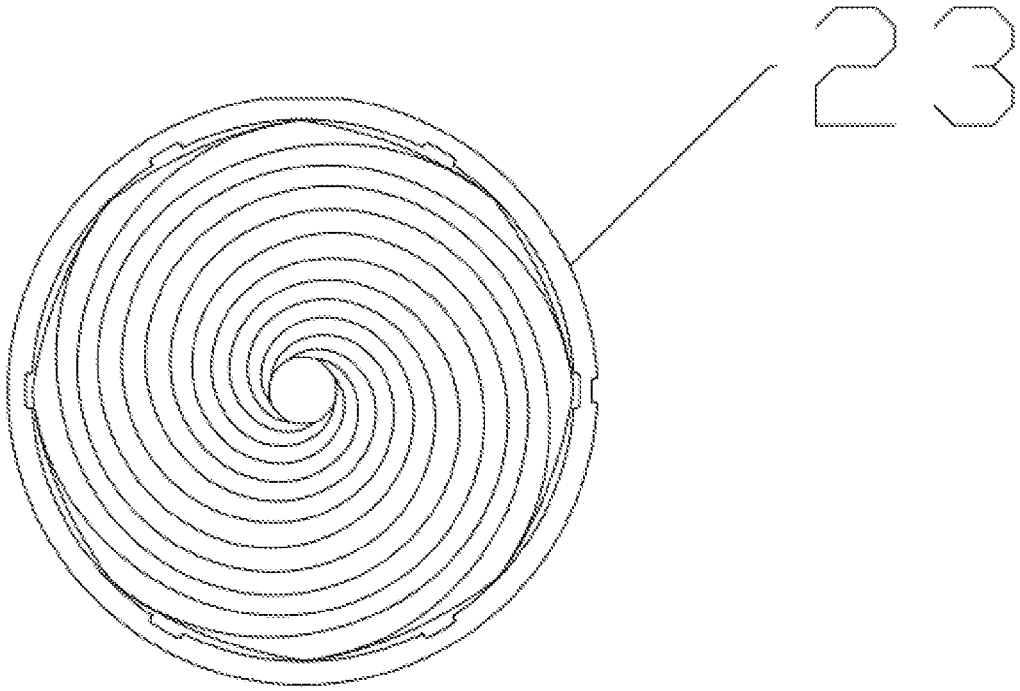
FIG. 15 is a first reference diagram of the pattern imaging transparent cover in Embodiment 1 according to the invention.
Figure 16:
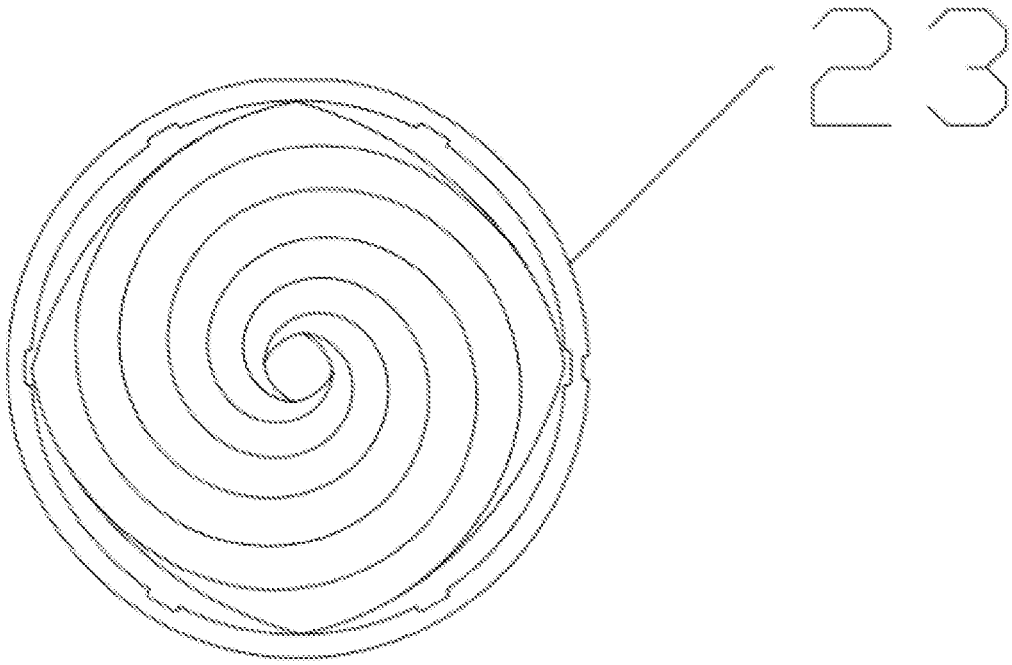
FIG. 16 is a second reference diagram of the pattern imaging transparent cover in Embodiment 1 according to the invention.

As shown in the figures: 1 refers to the casing; 2 refers to the projection component; 3 refers to the thumb wheel component; 4 refers to the swinging transparent water pattern cover; 5 refers to the swinging arm; 6 refers to the fixing plate; 7 refers to the projection lamp bead; 8 refers to the motor; 9 refers to the thumb wheel device body; 10 refers to the thumb wheel lamp brad; 11 refers to the thumb wheel pattern plate; 12 refers to the plano-convex condenser; 13 refers to the biconvex lens; 14 refers to the pattern plate fixing device; 15 refers to the pattern piece; 16 refers to the positioning groove; 17 refers to the laser component; 18 refers to the laser emitting device; 19 refers to the grating sheet; 20 refers to the grating cover; 21 refers to the upper casing; 22 refers to the lower casing; 23 refers to the pattern imaging transparent cover; 24 refers to the spring; 25 refers to the positioning column; 26 refers to the speaker; 27 refers to the circuit board.

5. SPECIFIC EMBODIMENT OF THE INVENTION

The embodiments of the invention are described in detail hereafter. Examples of the embodiments are shown in the accompanying drawings, in which the same or similar reference numerals indicate the same or similar elements or elements with the same or similar functions. In the description of the invention, it should be understood that the orientation or positional relationship indicated by the terms "upper", "lower", "front", "back, "left", "right", "inner", "outer", "vertical", "circumferential", etc. are based on the orientation or positional relationship shown in the drawings, and is only for the convenience of describing the invention and simplifying the description, but not indicate or imply that the pointed device or element must have a specific orientation, be constructed and operated in a specific orientation, and therefore cannot be understood as a limitation of the invention.

With reference to FIGS. 1-19, a new type of music starry sky projection lamp, comprising a casing 1, a projection component 2 provided in the casing 1, and a thumb wheel component 3;

The projection component 2 comprises a swinging transparent water pattern cover 4, a swinging arm 5, a fixing plate 6, a projection lamp bead 7, and a motor 8; both sides of the swinging transparent water pattern cover 4 are rotatably connected to the fixing plate 6; the lower end of the swinging arm 5 is eccentrically and fixedly connected to the output end of the motor 8; the upper end of the swinging arm 5 is rotatably matched with one side of the swinging transparent water pattern cover 4; the projection lamp bead 7 is arranged below the swinging transparent water pattern cover 4;

The thumb wheel component 3 comprises a thumb wheel device body 9, a thumb wheel lamp bead 10, a thumb wheel pattern plate 11, a plano-convex condenser 12, a biconvex lens, 13 and a pattern plate positioning device 14; the thumb wheel lamp bead 10, the thumb wheel pattern plate 11, the plano-convex condenser 12, and the biconvex lens are arranged from bottom to top on the inner side of the thumb wheel device body 9; the lower end of the pattern plate positioning device 14 passes through the thumb wheel device body 9 and is fixedly connected to the thumb wheel device body 9; the thumb wheel pattern plate 11 is rotatably connected to the thumb wheel device body 9; the thumb wheel pattern plate 11 is provided with pattern pieces 15 arranged in a ring shape; the outer side of the thumb wheel pattern plate 11 is provided with positioning grooves 16, and the positioning grooves 16 are matched with the lower end of the pattern plate positioning device 14.

A new type of music starry sky projection lamp, wherein it further comprises a laser component 17; the laser component 17 comprises a laser emitting device 18, a grating sheet 19, and a grating cover 20; the upper end of the laser emitting device 18 passes through the casing 1; the grating sheet 19 and the grating cover 20 are arranged on the upper end of the laser emitting device 18.

The casing 1 comprises an upper casing 21, a lower casing 22, and a pattern imaging transparent cover 23 that are arranged in combination up and down; the pattern imaging transparent cover 23 is arranged above the top surface of the upper casing 21 facing the projection component 2.

The pattern plate positioning device 14 comprises a spring 24 and a positioning column 25; the lower end of the positioning column 25 is matched with the positioning groove 16; the spring 24 is arranged between the thumb wheel device body 9 and the positioning column 25.

The casing 1 is provided with a speaker 26.

The casing 1 is provided with a circuit board 27.

Embodiment 1

With reference to FIGS. 1-16, when the invention is specifically implemented, turn on the projection component 2, the projection lamp beads 7 emit light through the swinging transparent water pattern cover 4 and then pass through the pattern imaging transparent cover 23; the inner surface of the pattern imaging transparent cover 23 simulates the Milky Way starry sky, and will be projected into a swirl-shaped light band effect; driven by the motor 8, the focal length of the swinging transparent water pattern cover 4 above the projection lamp bead 7 is changed, so that the pattern imaging transparent cover 23 can greatly simulate the effect of the irregular whirlpool-shaped light band in the universe galaxy. At the same time, start the motor 8, and the motor 8 drives the swinging arm 5 to rotate eccentrically, thereby swinging the swinging transparent water pattern cover 4, so that the projected pattern has a dynamic effect.

Turn on the thumb wheel component 3, the thumb wheel lamp bead 10 emits light and passes through the pattern piece 15, the plano-convex condenser 12 and the biconvex lens 13 in sequence, and the irradiated light image is a beautiful pattern. The projected pattern can be changed by rotating the thumb wheel pattern plate 11 to switch the pattern piece 15. The pattern plate positioning device 14 is used to precisely position the thumb wheel pattern plate 11, and the spring 24 pushes the positioning column 25 downward to lock the positioning groove 16 on the thumb wheel pattern plate 11.

When using the laser component 17, the laser light emitted by the laser emitting device 18 passes through the grating sheet 19 to project a laser effect.

During use, the speaker 26 can also be turned on to play music, which can better create an atmosphere.

Embodiment 2

Figure 17:
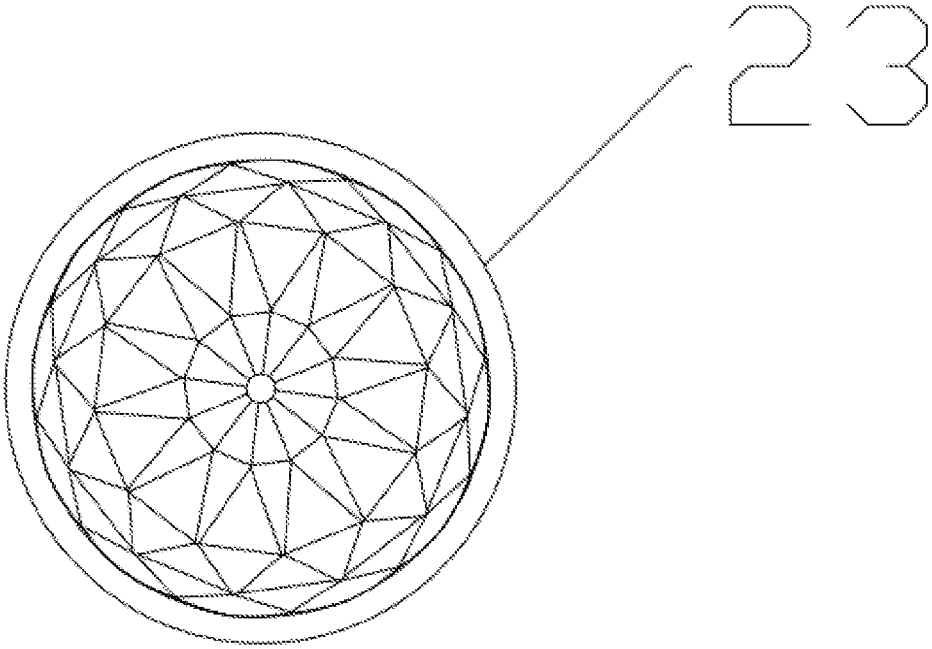
FIG. 17 is a reference diagram of the pattern imaging transparent cover in Embodiment 2 according to the invention.

With reference to FIG. 17, the difference between this embodiment and Embodiment 1 is that the inner surface of the pattern imaging transparent cover 23 is diamond-shaped, which can be projected into a cloud shape effect; driven by the motor 8, the diamond shape can simulate the light and shadow effects of irregular clouds in the sky to a great extent.

Embodiment 3

Figure 18:
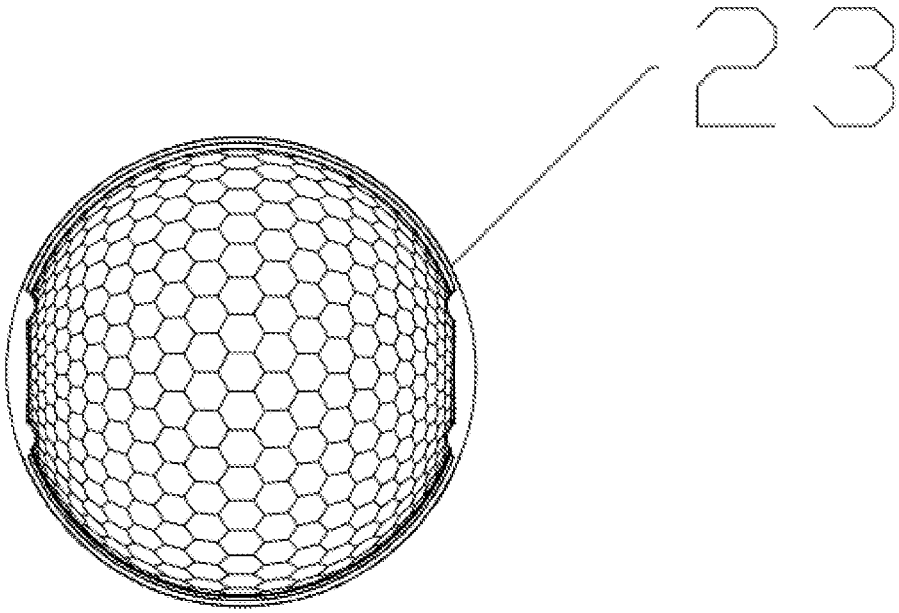
FIG. 18 is a reference diagram of the pattern imaging transparent cover in Embodiment 3 according to the invention.

With reference to FIG. 18, the difference between this embodiment and Embodiment 1 is that the inner surface of the pattern imaging transparent cover 23 is hexagonal, which can simulate the light and shadow effect of irregular water ripples on the water surface to a great extent; driven by the motor 8, the pattern imaging transparent cover 23 is imaged through the hexagonal pattern, and the light and shadow effect of irregular water ripples on the water surface can be simulated to a great extent.

Embodiment 4

Figure 19:
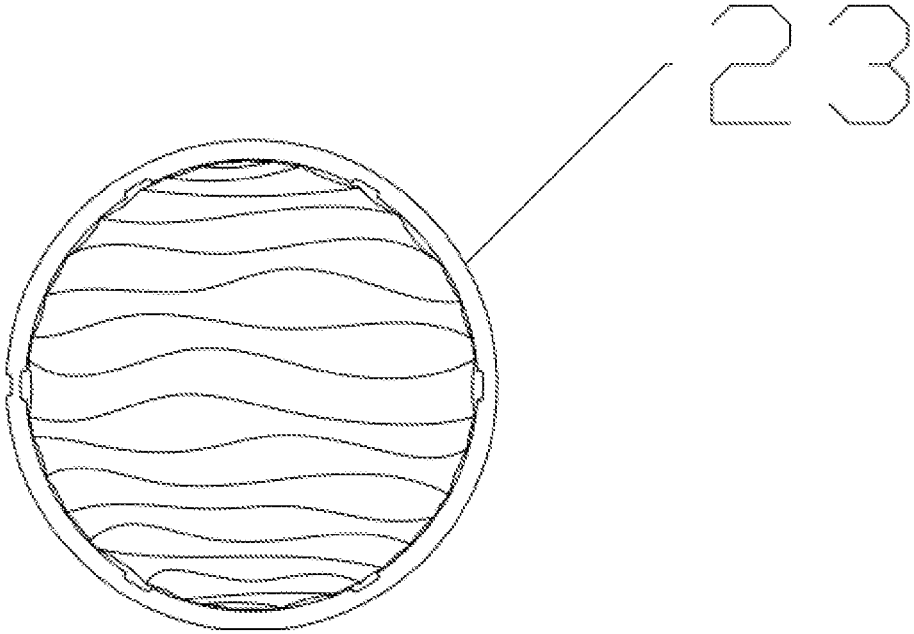
FIG. 19 is a reference diagram of the pattern imaging transparent cover in Embodiment 4 according to the invention.

With reference to FIG. 19, the difference between this embodiment and Embodiment 1 is that the inner surface of the pattern imaging transparent cover 23 is a long strip, which can project the effect of a long strip of light; driven by the motor 8, the long strip of light projected through the long strip pattern imaging transparent cover 23 changes and has a streamer effect.

The invention and the embodiments thereof are described hereinabove, and this description is not restrictive. What is shown in the drawings is only one of the embodiments of the invention, and the actual structure is not limited thereto. All in all, structural methods and embodiments similar to the technical solution without deviating from the purpose of the invention made by those of ordinary skill in the art without creative design shall all fall within the protection scope of the invention.

The invention claimed is:

1. A new type of music starry sky projection lamp, comprising:

a casing, a projection component provided in the casing, and a thumb wheel component, wherein the projection component comprises a swinging transparent water pattern cover, a swinging arm, a fixing plate, a projection lamp bead, and a motor; both sides of the swinging transparent water pattern cover are rotatably connected to the fixing plate; a lower end of the swinging arm is eccentrically and fixedly connected to an output end of the motor; an upper end of the swinging arm is rotatably matched with one side of the swinging transparent water pattern cover; the projection lamp bead is arranged below the swinging transparent water pattern cover;

the thumb wheel component comprises a thumb wheel device body, a thumb wheel lamp bead, a thumb wheel pattern plate, a plano-convex condenser, a biconvex lens, and a pattern plate positioning device; the thumb wheel lamp bead, the thumb wheel pattern plate, the plano-convex condenser, and the biconvex lens are arranged from bottom to top of and inside the thumb wheel device body; a lower end of the pattern plate positioning device passes through the thumb wheel device body and is fixedly connected to the thumb wheel device body; the thumb wheel pattern plate is rotatably connected to the thumb wheel device body; the thumb wheel pattern plate is provided with pattern pieces arranged in a ring shape; an outer edge of the thumb wheel pattern plate is provided with positioning grooves, and the positioning grooves are positionally matched with the lower end of the pattern plate positioning device.

2. The new type of music starry sky projection lamp of claim 1, wherein the projection lamp further comprises a laser component; the laser component comprises a laser emitting device, a grating sheet, and a grating cover; an upper end of the laser emitting device passes through the casing; the grating sheet and the grating cover are arranged on the upper end of the laser emitting device.

3. The new type of music starry sky projection lamp of claim 1, wherein the casing comprises an upper casing, a lower casing, and a pattern imaging transparent cover; the pattern imaging transparent cover is arranged above a top surface of the upper casing facing the projection component.

4. The new type of music starry sky projection lamp of claim 1, wherein the pattern plate positioning device comprises a spring and a positioning column; a lower end of the positioning column is matched with the positioning groove; the spring is arranged between the thumb wheel device body and the positioning column.

5. The new type of music starry sky projection lamp of claim 1, wherein the casing is provided with a speaker.

6. The new type of music starry sky projection lamp of claim 1, wherein the casing is provided with a circuit board.

* * * * *